US008731837B2

(12) United States Patent
Mehta et al.

(10) Patent No.: US 8,731,837 B2
(45) Date of Patent: May 20, 2014

(54) SYSTEM AND METHOD FOR ASSOCIATING TIME STAMPED MEASUREMENT DATA WITH A CORRESPONDING WELLBORE DEPTH

(75) Inventors: Shyam Mehta, Missouri City, TX (US); Sachin Bammi, Houston, TX (US); Keith Ray, Sugar Land, TX (US); Hiroshi Nomura, Kanagawa-Ken (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 764 days.

(21) Appl. No.: 12/814,104

(22) Filed: Jun. 11, 2010

(65) Prior Publication Data

US 2010/0313646 A1 Dec. 16, 2010

Related U.S. Application Data

(60) Provisional application No. 61/186,111, filed on Jun. 11, 2009.

(51) Int. Cl.
*G01V 1/40* (2006.01)

(52) U.S. Cl.
USPC ..... 702/6; 702/106; 702/176; 702/187

(58) Field of Classification Search
USPC ..... 702/6, 106, 176, 187; 367/81, 86; 340/853.1, 853.8, 870.01
See application file for complete search history.

(56) References Cited

U.S. PATENT DOCUMENTS

| | | | | |
|---|---|---|---|---|
| 5,517,464 | A | 5/1996 | Lerner et al. | |
| 5,642,051 | A | 6/1997 | Babour et al. | |
| 5,984,009 | A * | 11/1999 | DiFoggio | 166/250.13 |
| 6,641,434 | B2 | 11/2003 | Boyle et al. | |
| 7,633,834 | B2 * | 12/2009 | Mathiszik et al. | 367/57 |
| 7,730,967 | B2 * | 6/2010 | Ballantyne et al. | 175/40 |
| 8,434,354 | B2 * | 5/2013 | Crow et al. | 73/152.04 |
| 2008/0137474 | A1 * | 6/2008 | Dashevskiy et al. | 367/13 |
| 2009/0038392 | A1 | 2/2009 | Alfred et al. | |
| 2010/0085989 | A1 * | 4/2010 | Belhadj et al. | 370/503 |

FOREIGN PATENT DOCUMENTS

WO 2004085796 10/2004

* cited by examiner

*Primary Examiner* — Elias Desta
(74) *Attorney, Agent, or Firm* — Kimberly Ballew

(57) ABSTRACT

A system and a method for associating measurements from a wellbore with times and depths is provided. Tools located in a wellbore obtain the measurements and provide time data used to determine the times. The tools and a surface clock may be synchronized. The times may be used to associate the measurements with corresponding depths of the wellbore.

15 Claims, 8 Drawing Sheets

SYSTEM AND METHOD FOR ASSOCIATING TIME STAMPED MEASUREMENT DATA WITH A CORRESPONDING WELLBORE DEPTH

CROSS REFERENCE TO RELATED APPLICATIONS

This application claims priority from U.S. Patent Application Ser. No. 61/186,111, filed on Jun. 11, 2009, entitled "System and Method for Associating Measurements from a Wellbore with a Time and Depths," which is hereby incorporated by reference in its entirety.

BACKGROUND OF THE INVENTION

To obtain hydrocarbons, a drilling tool is driven into the ground surface to create a borehole through which the hydrocarbons are extracted. Typically, a drill string is suspended within the borehole. The drill string has a drill bit at a lower end of the drill string. The drill string extends from the surface to the drill bit. The drill string has a bottom hole assembly (BHA) located proximate to the drill bit.

Drilling operations typically require monitoring to determine the trajectory of the borehole. Measurements of drilling conditions, such as, for example, drift of the drill bit, inclination and azimuth, may be necessary for determination of the trajectory of the borehole, especially for directional drilling. As a further example, the measurements of drilling conditions may be information regarding the borehore and/or a formation surrounding the borehole. The BHA may have tools that may generate and/or may obtain the measurements. The measurements may be used to predict downhole conditions and make decisions concerning drilling operations. Such decisions may involve well planning, well targeting, well completions, operating levels, production rates and other operations and/or conditions. Moreover, the measurements are typically used to determine when to drill new wells, re-complete existing wells or alter wellbore production.

The measurements may be associated with a time that the measurements of drilling conditions are obtained. Typically, the tools have an internal timing mechanism synchronized with a computer located at the surface before the tools are used in the borehole. During use in the borehole, the tools obtain the measurements and associate the measurements with corresponding time data provided by the internal timing mechanism. The computer periodically calculates and records depths of the drill bit and associates a time with each depth of the drill bit. Thus, when the tools are retrieved from the borehole, the tools may transfer the measurements and the corresponding time data to the computer. The computer may use the time data to associate the measurements with corresponding depths of the drill bit. The computer may generate a log of the measurements as a function of the depth of the drill bit.

The above-described method of associating the depth of the drill bit with the measurements from tools retrieved from the borehole was acceptable for drilling that had relatively low rates of penetration, such as, for example, one hundred feet per hour or less. However, modern drilling operations may achieve rates of penetration over four hundred feet per-hour, such as, for example, approximately one thousand feet per hour, requiring analysis of the measurements while the tool is located in the borehole. In addition, the internal timing mechanism of the tool may experience drift relative to the computer located at the surface such that the time indicated by the internal timing mechanism may not match the time indicated by the computer. Drift of the internal timing mechanism varies for each tool and depends on time of use and temperature encountered. The drift causes inaccuracies in the log of the measurements as a function of the depth of the drill bit.

Technology for transmitting information within a borehole, known as telemetry technology, is used to transmit the measurements from the tools of the BHA to the surface for analysis while the tool is located in the borehole. However, the transmission of the measurements by a relatively slower telemetry technology may be hindered by the inclusion of the time data. Moreover, the telemetry technology may not have the capability to transmit the time data with the measurements. Instead of using time data transmitted from the tools, the computer located at the surface may calculate an estimated time to associate with the measurements received by the computer.

However, the estimated time is typically based on several assumptions that may render the estimated time inaccurate. For example, the estimated time may be based on assumptions regarding a rate of data acquisition for the tool, a data processing time for the tool, a data acquisition time for the telemetry system, a data processing time for the telemetry system, a data transmission time for the telemetry system, a data processing time for the computer and/or the like. These assumptions may vary in actual value and/or may be difficult to calculate. For example, the type of telemetry system used, an amount of data transmitted by the telemetry system and a depth of the tool from which the measurements are transmitted may cause a variance in the transmission time for the telemetry system that may render the estimated time inaccurate.

DETAILED DESCRIPTION OF THE PRESENTLY PREFERRED EMBODIMENTS

The present invention generally relates to a system and a method for associating time stamped measurement data with a corresponding wellbore depth. More specifically, the present invention relates to tools located in a wellbore that obtain the measurement data, and the measurement data is transmitted to the Earth's surface with time information.

Wellbore depths may also be recorded as a function of time. As a result, the measurement data may be associated with the wellbore depth in which the measurement data was obtained based on the time information.

One or more of the tools may have a downhole clock and a surface terminal or other device may have a surface clock. The downhole clock and the surface clock may be synchronized. In an embodiment, the tools may determine a drift so that the tools may continue synchronization despite interruption of communication with the surface location by the telemetry system. A master tool may synchronize with a surface clock and/or may synchronize other tools with the surface clock. In another embodiment, the surface clock may synchronize with all tools directly or via the master tool or any combination there of.

Figure 1:
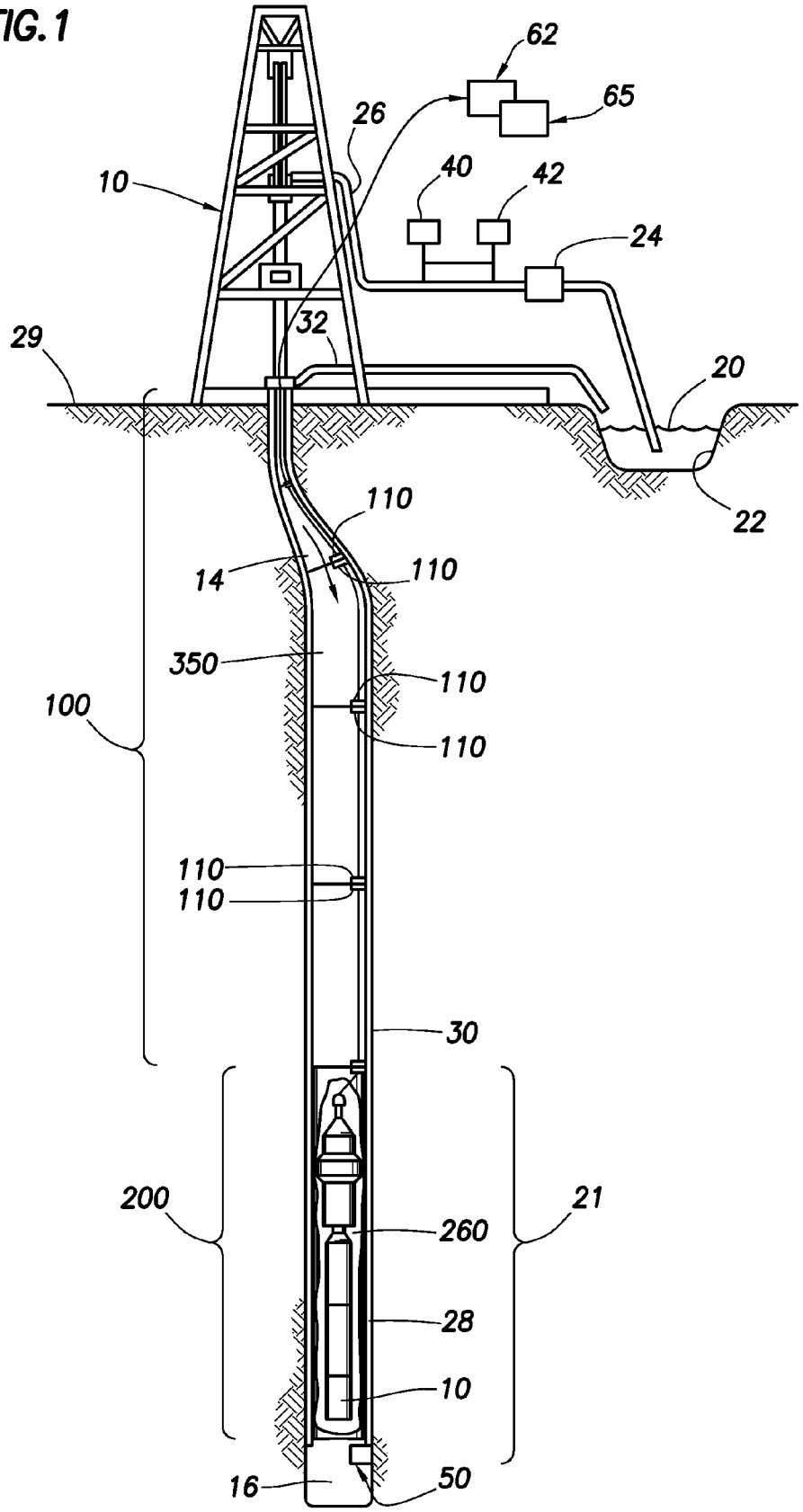
FIG. 1 illustrates a drill string in an embodiment of the present invention.

Referring now to the drawings wherein like numerals refer to like parts, FIG. 1 generally illustrates a borehole 30 that may penetrate a drilling surface in an embodiment of the present invention. A platform assembly 10 may be located at a surface location 29. The platform assembly 10 may be positioned over the borehole 30. A drill string 14 may be suspended within the borehole 30. The drill string 14 may have a drill bit 16 and/or a bottom hole assembly 21 (hereafter "the BHA 21") that may be located adjacent to the drill bit 16. The drill bit 15 may be rotated by imparting rotation on the drill string 14, and/or a motor or other device (not shown) may be provided with the drill string 14 to rotate the drill bit 15.

A drilling fluid 20, such as, for example, mud, may be drawn from a reservoir 22 using a first fluid line 26 that may have one or more pumps 24. The pump 24 may direct the drilling fluid 20 through the drill string 14 and/or the drill bit 16. The drilling fluid 20 may travel through an annulus 28 that may be located between the drill string 14 and a wall of the borehole 30. A second fluid line 32 may extend from the annulus 28 to the reservoir 22 and/or may direct the drilling fluid 20 from the annulus 28 to the reservoir 22.

One or more tools 10 may be associated with the BHA 21 and/or the drill string 14. The tools 10 may provide measurements regarding the borehole 30, a formation that may surround the borehole 30, the drill string 14 and/or any component of the drill string 14. For example, one or more of the tools 10 may be and/or may have a measurement-while-drilling ("MWD") tool, a logging-while-drilling ("LWD") tool, a strain measuring device, a torque measuring device, a temperature measuring device, a seismic tool, a resistivity tool, a direction measuring device, an inclination measuring device, a weight-on-bit measuring device, a vibration measuring device, a shock measuring device, a stick-slip measuring device, rotary steerable tool, sampling and testing tools, a drilling tool used to create the borehole 30 and/or the like.

In an embodiment, one or more of the tools 10 may be a wireline configurable tool, such as a tool commonly conveyed by wireline cable as known to one having ordinary skill in the art. In an embodiment, one or more of the tools 10 may be a well completion tool that may extract, may sample and/or may control reservoir fluid extracted from the reservoir. In an embodiment, one or more of the tools 10 may be a steering mechanism 50 that may control a direction of drilling, the rotation of the drill string 14, an inclination of the borehole 30 and/or an azimuth of the borehole 30. The present invention is not limited to a specific embodiment of the tools 10. FIG. 1 depicts the tools 10 in association with the BHA 21, but the present invention is not limited to a specific location of the tools 10 within the drill string 14.

Figure 2A:
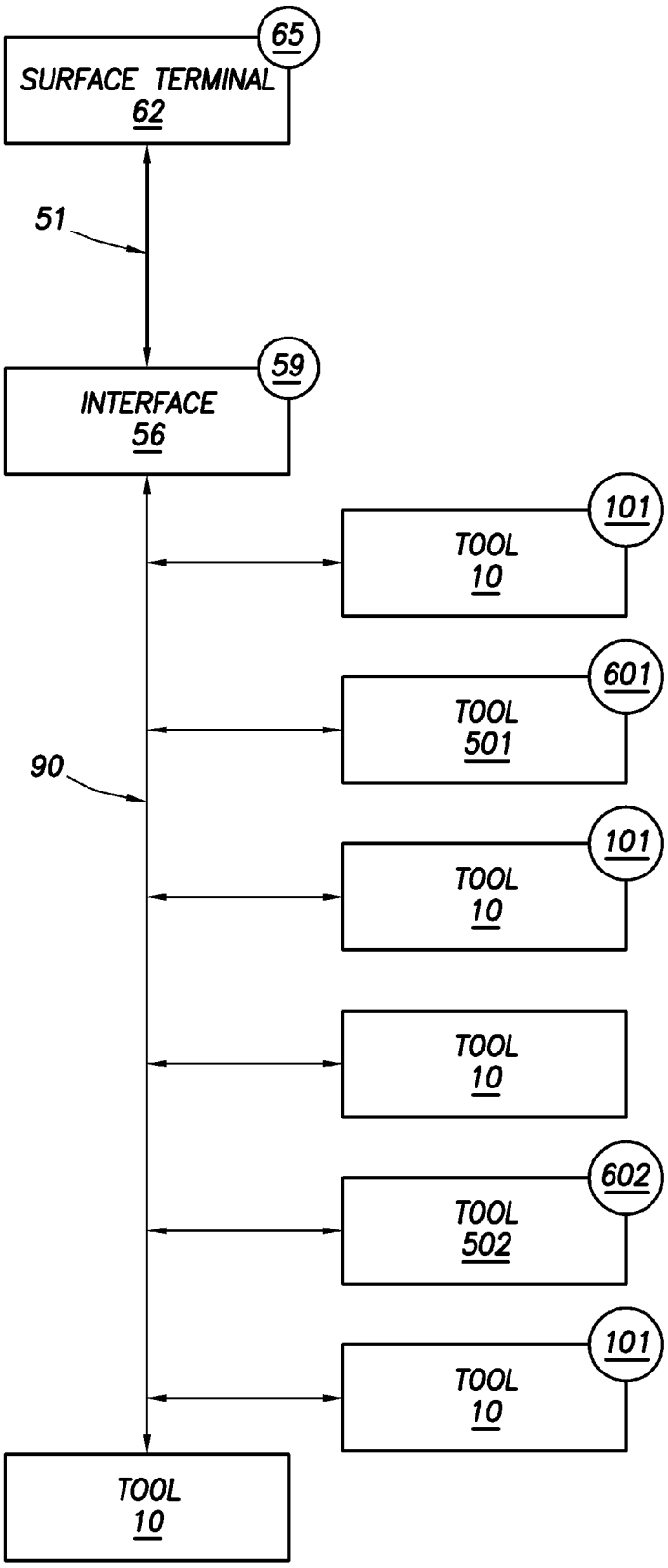
FIG. 2A illustrates a black box diagram of a system for associating measurements from a wellbore with times in an embodiment of the present invention.
Figure 2B:
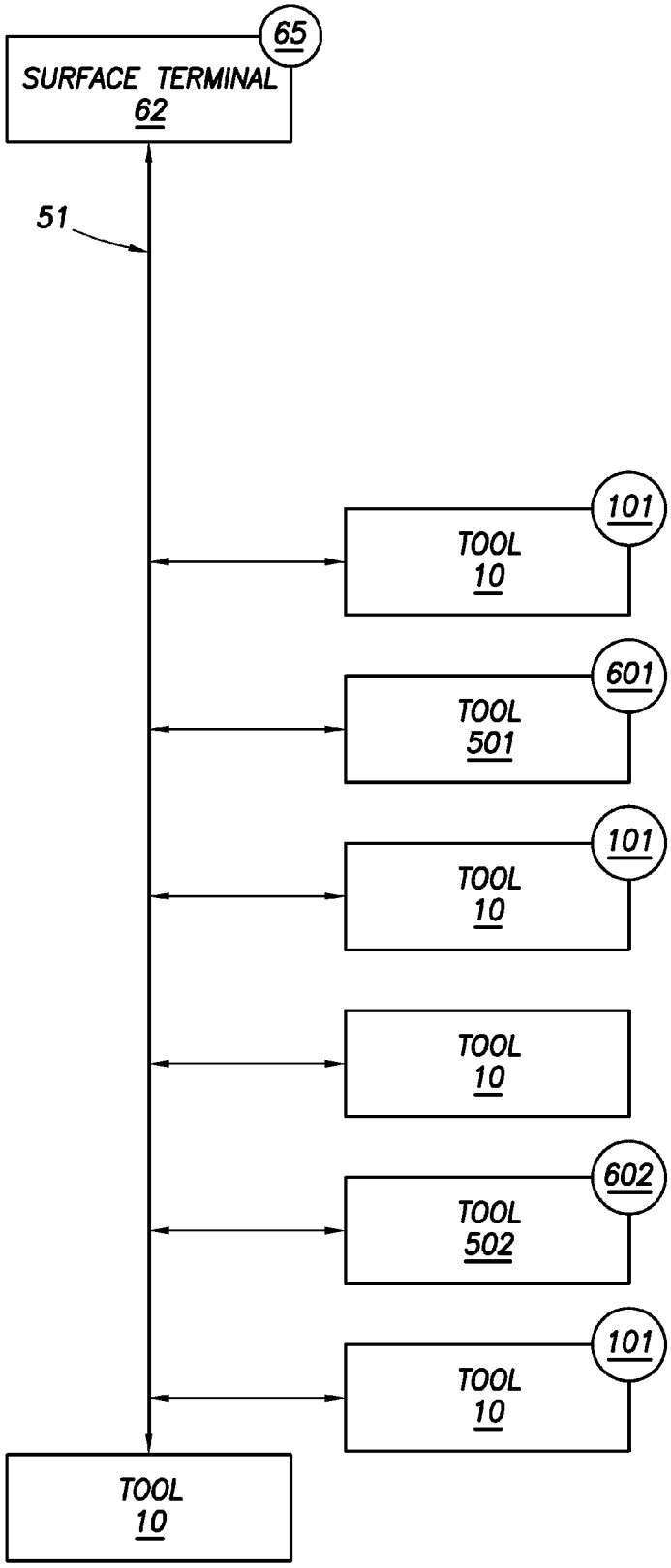
FIG. 2B illustrates a black box diagram of a system for associating measurements from a wellbore with times in an embodiment of the present invention.

As shown in FIGS. 2A and 2B, the tools 10 may be connected to a telemetry system 51 that may enable the tools 10 to communicate with the surface location 29. The telemetry system 51 may be any known telemetry system, such as, for example, a mud pulse telemetry system, wired drill pipe, a cable with electrical or fiber optic conductor, an electromagnetic telemetry system, an acoustic telemetry system, a torsional telemetry system, a hybrid telemetry system that may combine the above-described telemetry systems and/or the like. An example of a mud pulse telemetry system is described in U.S. Pat. No. 5,517,464 to Lerner et al.; an example of a wired drill pipe is described in U.S. Pat. No. 6,641,434 to Boyle et al.; an example of an electromagnetic telemetry system is described in U.S. Pat. No. 5,642,051 to Babour et al.; and an example of an acoustic telemetry system is described in PCT Patent App. Pub. No. WO/2004/085796 to Huang et al. Each of these references is incorporated herein by reference in its entirety.

As shown in FIG. 1, in an embodiment where the telemetry system 51 may be wired drill pipe 100, the telemetry system 51 may consist of one or more wired drill pipe joints 110 (hereafter "the WDP joints 110"). The WDP joints 110 may be interconnected to form the drill string 14. The wired drill pipe 100 and/or the WDP joints 110 may enable the tools 10 to communicate with the surface location 29. An example of a WDP joint that may be used in the wired drill pipe 100 is described in detail in U.S. Pat. No. 6,641,434 to Boyle et al., herein incorporated by reference in its entirety. The present invention is not limited to a specific embodiment of the wired drill pipe 100 and/or the WDP joints 110. The wired drill pipe 100 may be any system that may enable the tools 10 to communicate with the surface location 29 as known to one having ordinary skill in the art.

As shown in FIG. 1, the telemetry system 51 may be a mud pulse telemetry system 200 in an embodiment. The mud pulse telemetry system 200 may have a Measurement-While-Drilling module 260 (hereafter "MWD module 260") that may be located in the borehole 30 and/or may be associated with the BHA 21. The mud pulse telemetry system 200 and/or the MWD module 260 may control flow of the drilling fluid 20 through the drill string 14. By controlling the flow of the drilling fluid 20, the MWD module 260 may cause pressure changes in the drilling fluid 20 located in the drill string 14 and/or the first fluid line 26. The pressure changes in the first fluid line 26 may be detected by a sensor 40 which may be connected to a processor 42. The pressure changes in the drilling fluid 20 may be indicative of data, and/or the processor 42 may obtain the data based on the pressure changes in the drilling fluid 20.

An example of a mud pulse telemetry system 200 that may be used in the present invention is described in detail in U.S. Pat. No. 5,375,098 to Malone et al., herein incorporated by reference in its entirety. The present invention is not limited to a specific embodiment of the mud pulse telemetry system 200 and/or the MWD module 260. The mud pulse telemetry system 200 may be any system that may use the drilling fluid 20 to enable the tools 10 to communicate with the surface location 29 as known to one having ordinary skill in the art.

As discussed previously, the telemetry system 51 may be a hybrid telemetry system. For example, the telemetry system 51 may have the wired drill pipe 100 extending from the surface location 29 to a position within the borehole and the mud pulse telemetry system 200 extending from the position within the borehole 30 to the BHA 21. The present invention is not limited to a specific embodiment of the telemetry system 51. The telemetry system 51 may be any telemetry system that enables the tools 10 to communicate with the surface location 29 as known to one having ordinary skill in the art. The present invention is not limited to a specific number of telemetry systems, and the tools 10 may use any number of telemetry systems to communicate with the surface location 29. The surface location may also communicate with the tool 10 as required via downlink telemetry which can be any telemetry method, such as wired pipe, cable, electromagnetic and others. The uplink and the downlink telemetry may occur simultaneously.

As shown in FIGS. 1 and 2, the telemetry system 51 may be connected to a terminal 62. The terminal 62 may be, for example, a desktop computer, a laptop computer, a mobile cellular telephone, a personal digital assistant ("PDA"), a 4G mobile device, a 3G mobile device, a 2.5G mobile device, an internet protocol (hereinafter "IP") video cellular telephone, an ALL-IP electronic device, a satellite radio receiver and/or the like. The terminal 62 may be located at the surface location 29 and/or may be remote relative to the borehole 30. The present invention is not limited to a specific embodiment of the terminal 62, and the terminal 62 may be any device that has a capability to communicate with the tools 10 using the telemetry system 51. Any number of terminals may be connected to the telemetry system 51, and the present invention is not limited to a specific number of terminals.

The terminal 62 may have a surface clock 65 that may indicate a surface time $t_{surface}$. For example, the surface clock 65 may have a circuit connected to an oscillator, such as, for example, a quartz crystal, as known to one having ordinary skill in the art. The surface clock 65 may increase the surface time $t_{surface}$ incrementally by action of the oscillator. The surface clock 65 may be a real time clock that may indicate a time of a day. For example, if the surface clock 65 is a real time clock, the surface clock 65 may indicate a time ante meridiem (A.M.), a time post meridiem (P.M.), a military time that may use a twenty-four hour time frame and/or the like.

The surface clock 65 may be synchronized using GPS signals as known to one having ordinary skill in the art. For example, the surface clock 65 may have a GPS receiver. GPS satellites may be positioned in orbit around earth and may provide signals to the GPS receiver of the surface clock 65. The GPS receiver may use the signals provided by the GPS satellites to determine the surface time $t_{surface}$. The present invention is not limited to a specific embodiment of the surface clock 65, and the tool clock 65 may be any device capable of generating the surface time $t_{surface}$ for the terminal 62 as known to one having ordinary skill in the art. The tools 10 may continuously synchronize with the surface clock 65 and/or the surface time $t_{surface}$ as described in more detail hereafter. For example, the tools 10 may have an internal battery-powered clock, but may determine a time using the surface time $t_{surface}$ transmitted from the surface clock 65 instead of the internal battery-powered clock as discussed in more detail hereafter.

As shown in FIG. 2A, each of the tools 10 may be connected to a tool bus 90. For example, the tool bus 90 may be a wire that may connect each of the tools 10 to each other. The tool bus 90 may be wired or wireless or any combination of wired and wireless sections. For example, each of the tools 10 may have a wire segment, and/or the wire segments may form the tool bus 90. The tool bus 90 may connect the telemetry system 51 to the tools 10. FIG. 2B illustrates an embodiment in which at least one of the tools 10 is connected directly to the telemetry system 51, or is otherwise connected to the telemetry system 51 without connection to the tool bus 90. It should be appreciated that either of these embodiments, combinations of these embodiments and variations may be easily incorporated into the invention.

The tools 10 and the telemetry system 51 may communicate using the tool bus 90. The tool bus 90 may utilize a 250 kHz carrier frequency that may be modulated between 200 kHz and 300 kHz. In another embodiment, the communications methodology may be phase or amplitude modulation. The present invention should not be deemed as limited by the communications methodology used on the bus described herein. A person having ordinary skill in the art will appreciate other communications methodologies may be used within the spirit of the invention. The tool bus 90 may provide electrical power to the tools 10. The present invention is not limited to a specific embodiment of the tool bus 90, and the tool bus 90 may be any apparatus that may be used by the tools 10 and the telemetry system 51 to communicate with each other.

The telemetry system 51 may have an interface 56 that may be located in the borehole 30 and/or may be associated with the BHA 21. The tool bus 90 may connect the tools 10 to the interface 56. The interface 56 may operate as an interface between the telemetry system 51 and the tool bus 90 and/or the tools 10. The interface 56 may enable the tool bus 90 and/or the tools 10 to communicate with the telemetry system 51.

In an embodiment where the telemetry system 51 may be the mud pulse telemetry system 200, the interface 56 may be the MWD module 260. In an embodiment where the telemetry system 51 may be the wired drill pipe 100, the interface 56 may be a wired drill pipe interface sub (hereafter "the WDP interface"). The WDP interface may enable the tool bus 90 and/or the tools 10 to communicate with the wired drill pipe 100, and/or the MWD module 260 may enable the tool bus and/or the tools 10 to communicate with the mud pulse telemetry system 200.

The interface 56 may have an internal timing mechanism 59. The internal timing mechanism 59 may be synchronized with the surface clock 65 of the terminal 62 before the telemetry system 51 and/or the interface 56 are used within the borehole 30. The internal timing mechanism 59 of the interface 56 may provide an interface time $t_{interface}$ that may be based on and/or may correspond to the surface time $t_{surface}$. For example, the interface may have an oscillator, such as, for example, a quartz crystal, as known to one having ordinary skill in the art, for determining the interface time $t_{interface}$. The internal timing mechanism 59 of the interface 56 and the surface clock 65 may synchronize as described in more detail hereafter. The present invention is not limited to a specific embodiment of the interface 56 or the internal timing mechanism 59 of the interface 56. The internal timing mechanism may be any device that generates a time for the interface 56.

The tools 10 may have capabilities for measuring, processing and/or storing information. The tools 10 may have a sensor, such as, for example, a gauge, a temperature sensor, a pressure sensor, a flow rate measurement device, an oil/water/gas ratio measurement device, a scale detector, a vibration sensor, a sand detection sensor, a water detection sensor, a viscosity sensor, a density sensor, a bubble point sensor, a composition sensor, a resistivity array sensor, an acoustic sensor, a near infrared sensor, a gamma ray detector, internal and annulus pressure, formation pressure, inclination and azimuth sensors, a $H_2S$ detector, a $CO_2$ detector and/or the like.

For example, the tools 10 may measure, may record and/or may transmit data acquired from and/or through the borehole 30 (hereinafter "the data"). The data may relate to the borehole 30 and/or the formation that may surround the borehole 30. For example, the data may relate to one or more characteristics of the formation and/or the borehole 30, such as, for example, a temperature, a pressure, a depth, a composition, a density and/or the like. The data may relate to one or more characteristics of the drill string 14, such as, for example, an amount of stretch, an amount of strain, an angle, a direction, a characteristic of fluid flowing through the drill string 14, a dog-leg severity and/or the like. For example, the data may indicate a trajectory of the borehole 30, a depth of the borehole 30, a caliper of the borehole 30 and/or the like. Further, the data may be and/or may indicate, for example, a location of the drill bit 16, an orientation of the drill bit 16, a weight applied to the drill bit 16, a rate of penetration, properties of an earth formation being drilled, properties of an earth formation and/or a hydrocarbon reservoir located proximate to the drill bit 16, fluid conditions, fluids collected and/or the like. Still further, the data may be, for example, resistivity measurements, neutron porosity measurements, azimuthal gamma ray measurements, density measurements, elemental capture spectroscopy measurements, neutron gamma density measurements that measure gamma rays generated from neutron formation interactions, sigma measurements and/or the like. The data may be and/or may indicate an inclination of the borehole 30 and/or an azimuth of the borehole 30, for example. The data may indicate annular pressure, three-axis shock and/or vibration, for example. The data may be measured and/or obtain at predetermined time intervals, at predetermined depths, at request by a user, command from the terminal, triggered based on event and/or the like. The present invention is not limited to a specific embodiment of the data.

Figure 3A:
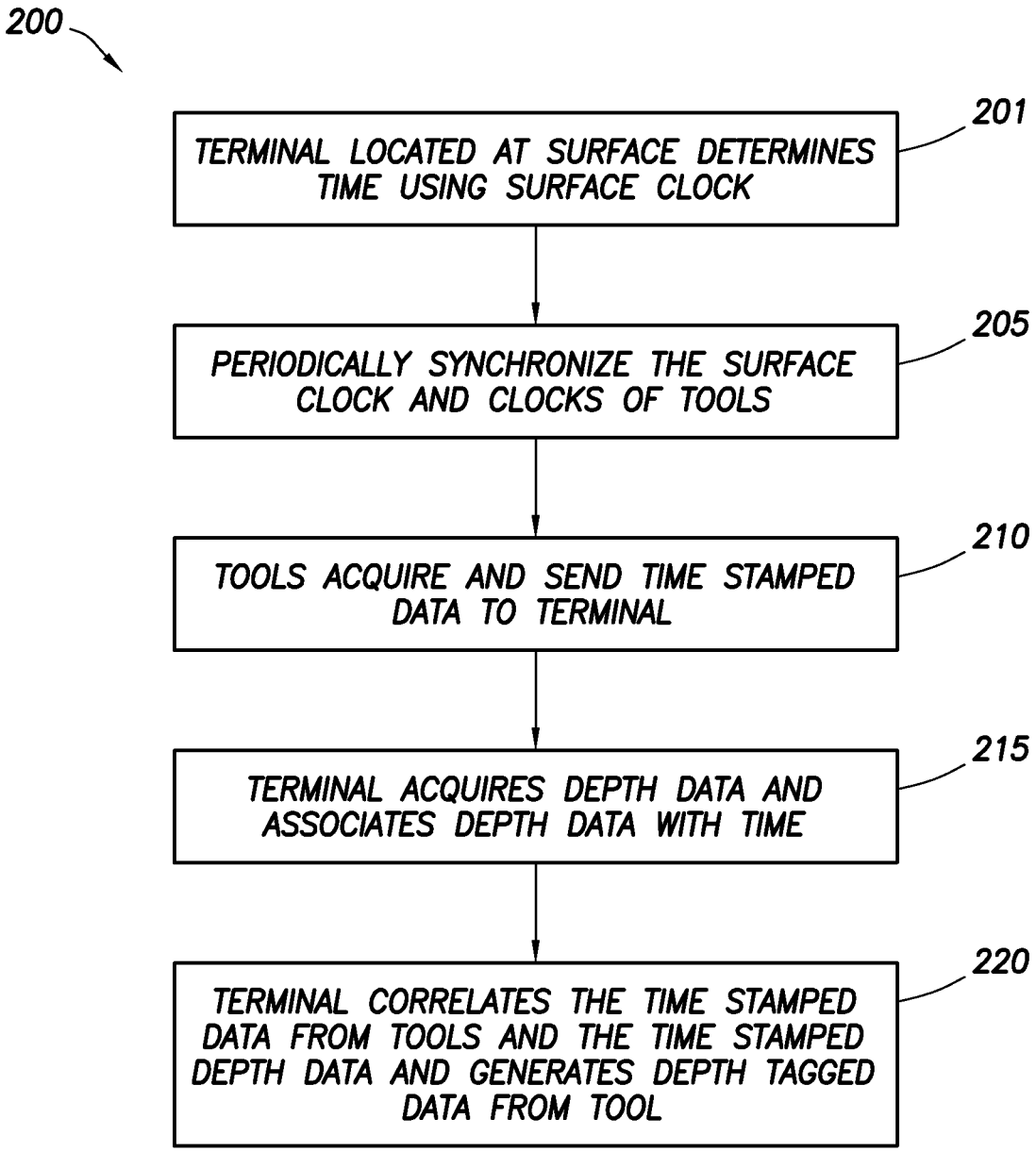
FIG. 3A illustrates a flowchart of a method for associating measurements from a wellbore with times in an embodiment of the present invention.

FIG. 3A generally illustrates a flowchart of a method 200 for determination of timestamps to associate with the data in an embodiment of the present invention. The terminal 62 may associate the data obtained by the tools 10 with the timestamps as discussed in more detail hereafter. The timestamps may be based on information transmitted with the data from the tools 10 and/or the interface 56 and may be included with the data. The tools 10 and/or the interface 56 may transmit the data to the terminal 62 in association with the timestamps which may be synchronized with the terminal. For example, each of the timestamps may correspond to a time when the data was obtained. For example, a first set of data obtained at a first time may be associated with a first timestamp that may indicate the first time, and/or a second set of data obtained at a second time may be associated with a second timestamp that may indicate the second time.

As generally shown at step 201, the terminal 62 may determine surface times $t_{surface}$ that may be provided by the surface clock 65 of the terminal 62. As generally shown at step 205, the interface 56, the tools 10 and/or the surface clock 65 may synchronize. For example, the internal timing mechanism 59 of the interface 56 may experience drift relative to the surface clock 65, and/or the surface clock may experience drift relative to the internal timing mechanism 59 of the interface 56. As a result of the drift of the internal timing mechanism 59 of the interface 56 and/or the surface clock 65, a time provided by the internal timing mechanism 59 at a specific time may not match a time provided by the surface clock 65 at the specific time. The drift of the internal timing mechanism of the interface 56 and/or the surface clock 65 may prevent the data from receiving accurate time information. Therefore, the interface 56 and/or the terminal 62 may periodically synchronize the internal timing mechanism 59 of the interface 56 and the surface clock 65.

As a further example, as generally shown in FIGS. 2A and 2B, a first tool 501 of the tools 10 and/or a second tool 502 of the tools 10 may have a first clock 601 and/or a second clock 602, respectively. The first clock 601 and/or the second clock 602 may be an internal battery-powered clock, for example. The first clock 601 and/or the second clock 602 may have a microprocessor and/or may have an oscillator, such as, for example, a quartz crystal, as known to one having ordinary skill in the art, for determining times. The present invention is not limited to a specific embodiment of the first clock 601 or the second clock 602 or a specific number of tools 10 having clocks.

The first clock 601 and/or the second clock 601 may experience drift relative to the surface clock 65, and/or the surface clock 65 may experience drift relative to the first clock 601 and/or the second clock 601. As a result of the drift of the first clock 601, the second clock 601 and/or the surface clock 65, a time provided by the first tool 501 and/or the second tool 502 at a specific time may not match a time provided by the surface clock 65 at the specific time. The drift of the first clock 601, the second clock 601 and/or the surface clock 65 may prevent the data from receiving accurate time information. Therefore, referring again to FIG. 3A, the first clock 601, the second clock 602 and/or the surface clock 65 of FIGS. 2A and 2B may periodically synchronize as generally shown at step 205.

The interface 56, the first tool 501, the second tool 502 and/or the terminal 62 may use any means known to one having ordinary skill in the art to synchronize the internal timing mechanism 59 of the interface 56, the first clock 601, the second clock 602 and/or the surface clock 65. For example, the internal timing mechanism 59 of the interface 56, the first clock 601, the second clock 602 and/or the surface clock 65 may synchronize using messages transmitted between the interface 56, the first tool 501, the second tool 502 and/or the terminal 62.

Synchronization may be periodic such that the interface 56, the first tool 501, the second tool 502 and/or the terminal 62 messages synchronize at predetermined time intervals. A time interval for synchronization may be based on the drift. For example, the time interval may be one second if the drift may be relatively high. As a further example, the time interval may be one hour if the drift may be relatively low. In an embodiment, an accuracy of synchronization may be approximately one millisecond to approximately ten seconds. For example, synchronization of the internal timing mechanism 59 of the interface 56, the first clock 601, the second clock 602 and/or the surface clock 65 may cause times provided by the internal timing mechanism 59 of the interface 56, the first clock 601, the second clock 602 and/or the surface clock 65 to be within one millisecond of each other. The present invention is not limited to a specific embodiment of the time interval or the accuracy of synchronization.

As generally shown at step 210, the first tool 501 and/or the second tool 502 may obtain the data and/or may associate the data with a timestamp. The interface 56, the first tool 501 and/or the second tool 502 may transmit the data to the terminal 62 in association with the timestamp. The data and/or the timestamp may be transmitted to the terminal 62 using the telemetry system 51. The timestamp may be the time that the data was obtained, for example. In another example, when a range of data is acquired at a specific interval, the timestamp may be associated with any interval related to the acquisition time, such as an initial acquisition time of the range of data, a completed acquisition time of the range of data, or a time in between the initial acquisition time and the completed acquisition time for the range of data. If the data was transmitted from the first tool 501, the timestamp may be a time provided by the first clock 601. If the data was transmitted from the second tool 502, the timestamp may be a time provided by the second clock 602. In an embodiment, the timestamp may be a time provided by the internal timing mechanism 59 of the interface 56, such as, for example, if one or more of the tools 10 transmitting the data may not be capable of providing a time for the timestamp. The interface 59 may adjust the timestamp for the delay between the acquisition time and the time in which the timestamp is associated.

As generally shown at step 215, the terminal 62 may determine depths of the drill bit 15 and/or the drill string 14 at various times. For example, the terminal 62 may associate the depths with times provided by the surface clock 65. An example of a method for associating the depths with the various times that may be used in the present invention is described in detail in U.S. Patent App. Pub. No. 2009/0038392 to Alfred et al., herein incorporated by reference in its entirety. The present invention is not limited to a specific embodiment of the method for associating the depths with the various times. For example, each sensor may measure points that are known based on the BHA design, the depth can be calculated based on the measured bit depth, and the depths may then be associated with the time.

As generally shown at step 220, the terminal 62 may associate the appropriate depths with the data. For example, the terminal 62 may associate one of the sensor depths corresponding to a specific time with a portion of the sensor data corresponding to the specific time. The terminal 62 may receive the depths at a different rate than the terminal 62 may receive the data. For example, the terminal 62 may receive the depths at a rate of two Hz, ten Hz, 100 Hz, 1000 Hz, and/or the like. The present invention is not limited to a specific embodiment of a rate of receipt of the depths.

The terminal 62 may generate and/or may display a report, such as, for example, a depth log as known to one having ordinary skill in the art. The report may have and/or may display the data in association with the timestamps and/or the depths. For example, the report may display each of the depths in association with the corresponding portion of the data. In an embodiment, the report may be a log of the borehole, such as a record of the geological formations of the borehole.

In an embodiment, the surface clock 65 may be a master clock such that the first clock 601, the second clock 602 and/or the internal timing mechanism 59 of the interface 56 may be synchronized based on the time provided by the surface clock 65. Therefore, the first clock 601, the second clock 602 and/or the internal timing mechanism 59 of the interface 56 may be synchronized to compensate for the drift of the first clock 601, the second clock 602, the clocks of the other tools 10 and/or the internal timing mechanism 59 of the interface 56 relative to the surface clock 65. The present invention is not limited to a specific embodiment and/or location of the master clock. For example, the first clock 601 may be the master clock such that the second clock 602, the internal timing mechanism 59 of the interface 56 and/or the surface clock 65 may be synchronized to compensate for the drift of the second clock 602, the internal timing mechanism 59 of the interface 56 and/or the surface clock 65 relative to the first clock 601. All clocks in the drilling system from the surface clock 65 to the BHA, the other components in the drill string, repeaters (not shown), the interface 56 and/or the tool 10 may be synchronized. In case of wired drill pipe telemetry or other telemetry system that may have components with internal clocks, such as repeaters, these internal clocks may also be synchronized with the surface clock 65, especially if the components include a sensor and acquire data.

Figure 3B:
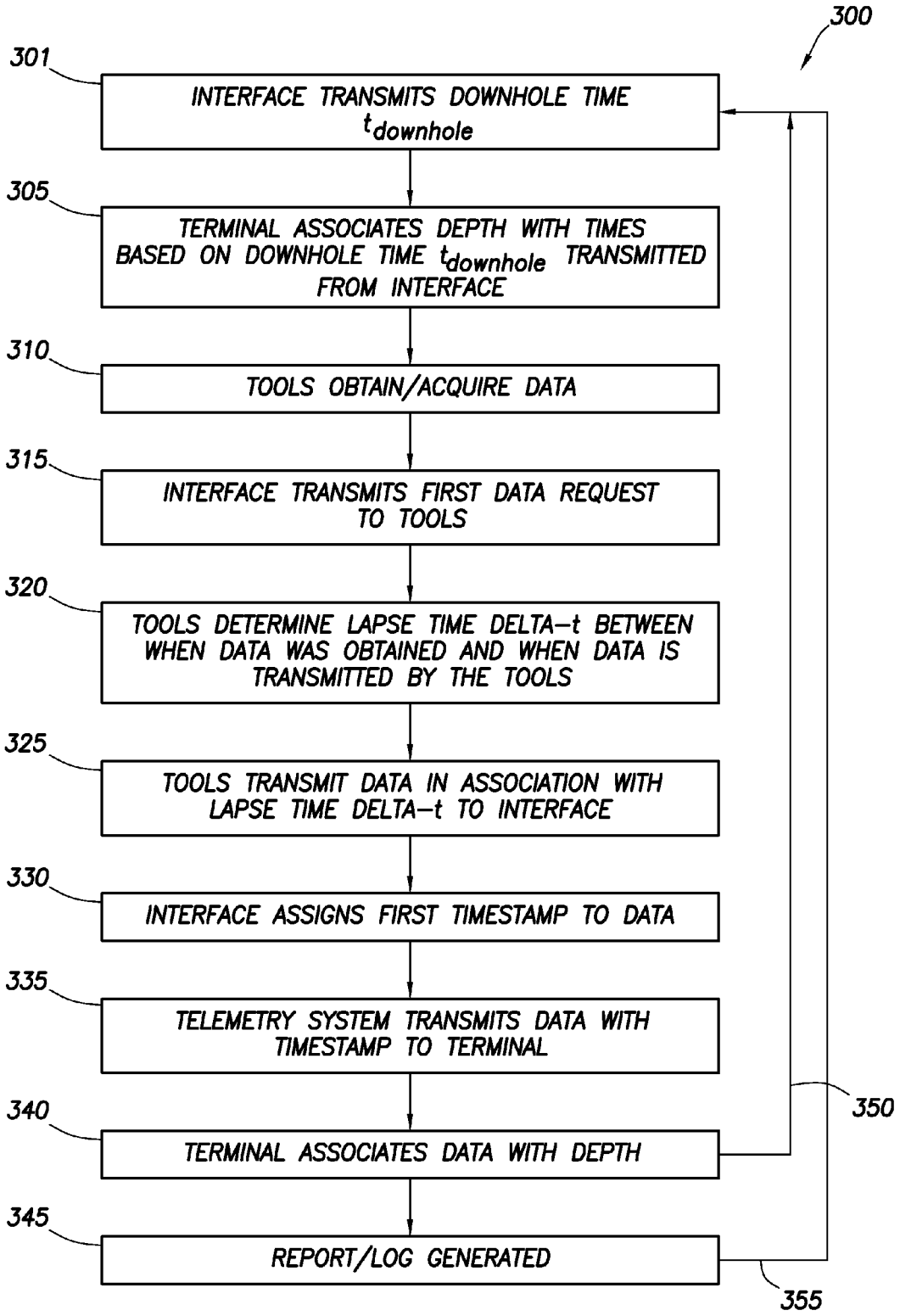
FIG. 3B illustrates a flowchart of a method for associating measurements from a wellbore with times in an embodiment of the present invention.

FIG. 3B generally illustrates a flowchart of a method 300 for using the internal timing mechanism 59 of the interface 56 as the master clock for association of timestamps with the data in an embodiment of the present invention. As generally shown at step 301, the interface 56 may periodically transmit a message to the terminal 62 using the telemetry system 51. The message may indicate a first downhole time $t_{downhole}$ that may be provided by the internal timing mechanism 59 of the interface 56. For example, the message may be a "ping" message. As known to one having ordinary skill in the art, a "ping" message may be a message that requests a recipient device for a response. The message may indicate the first downhole time $t_{downhole}$ and/or may request a response from the terminal 62. The terminal 62 may transmit the response to the "ping" message to the interface 56 using the telemetry system 51. For example, the terminal 62 may transmit the response substantially simultaneously to receipt of the message.

Receipt of the response from the terminal 62 by the interface 56 may indicate a round-trip transmittal time. The round-trip transmittal time may be the difference between the time the response was received by the interface 56 relative to the time the "ping" message was sent by the interface 56. The round-trip transmittal times associated with "ping" messages may be sent to the terminal 62 by the interface 56 and/or stored by the terminal 62 and/or the interface 56. The terminal 62 and/or the interface 56 may calculate an average round-trip time $t_{roundtrip}$ based on the round-trip transmittal times associated with previous "ping" messages. The "ping" messages transmitted from the interface 56 to the terminal 62 may indicate the average round-trip time $t_{roundtrip}$ of the previous "ping" messages. The interface 56 transmits the $t_{downhole}$ to the terminal 62 at predetermined interval as previously described, and the terminal 62 synchronizes the time $t_{surface}$ with the $t_{downhole}$. The time $t_{surface}$ may be adjusted to account for the delay involved between the time the interface 56 actually transmits the time information to the terminal 62 and the time in which the terminal 62 receives the time information. This time difference may be significant in case of some types of telemetry like wired drill pipe, where there are repeaters in between. Until the next interface time $t_{downhole}$ is received, the terminal will continue to increment the synchronized time $t_{surface}$ with its internal clock. When the terminal 62 receives the next interface time $t_{downhole}$, the terminal 62 will resynchronize $t_{surface}$.

As discussed previously, the terminal 62 may determine depths of the drill bit 15 and/or various sensor measure points in the drill string 14. As generally shown at step 305, the terminal 62 may associate the depths with times. The terminal 62 may associate the depth data with time $t_{surface}$ which may be synchronized with the time $t_{downhole}$, such as from the interface 56. For example, the first depth is associated with the first surface time $t1_{surface}$ and the second depth is associated with the second surface time $t2_{surface}$ and so on. In yet another example, the terminal 62 may determine a first depth after receiving the first downhole time $t_{downhole}$ from the interface 56. The terminal 62 may not associate the first depth with the current time provided by the surface clock 65. Instead, the time $t_{surface}$ to associate with the first depth may be based on the average round-trip time $t_{roundtrip}$ and the first downhole time $t_{downhole}$ that may be provided by the message from the interface 56.

As generally shown at step 310, the tools 10 may obtain or acquire data and associate the time when the data was acquired using an internal clock of the tools 10. Data associated with timestamp may be stored in internal memory of the tools 10. As generally shown at step 315, the interface 56 may transmit a first data request that may request the first set of data from the tools 10. The interface 56 may transmit the first data request to the tools 10 using the tool bus 90. The interface 56 may transmit the first data request at a second downhole time $t_{downhole}$. The terminal 62 may direct that the interface 56 transmit the first data request, and/or the first data request may be one of a plurality of data requests transmitted from the interface 56 periodically at predetermined time intervals. The first data request may indicate which of the tools 10 may be intended to respond to the first data request.

As generally shown at step 320, the tools 10 may determine a lapse time delta-t based on a time the tools 10 transmit the data. The lapse time delta-t may be the difference between when the data was obtained and the time the tools 10 transmit the data. For example, the tools 10 may have an oscillator, such as, for example, a quartz crystal, as known to one having ordinary skill in the art, for determining the lapse time delta-t.

One or more of the tools 10 may not be capable of determining a current time but may be capable of determining the lapse time delta-t using the oscillator. For example, one or more of the tools 10 may not be capable of determining the current time because one or more of the tools 10 may not have an internal battery-powered clock. The tools 10 that may not have an internal battery-powered clock may be reset and/or may lose power after receiving the most recent downhole time $t_{downhole}$ transmitted by the interface 56. However, oscillations of the oscillator may indicate the lapse time delta-t. Therefore, the tools 10 that may not be capable of determining the current time may associate the data with the lapse time delta-t. Further, one or more of the tools 10 may be capable of determining the current time using an internal battery-powered clock. The tools 10 that may be capable of determining the current time may associate the data with the lapse time delta-t and/or may not associate the data with the current time provided by the internal battery-powered clock.

As generally shown at step 325, the tools 10 specified by the data request may transmit the data in association with the lapse time delta-t to the interface 56 using the tool bus 90. For example, the tools 10 may transmit a first encoded message that may encode the data in association with the lapse time delta-t. The tools 10 may transmit the first encoded message to the interface 56 using the tool bus 90. In yet another embodiment, the tools 10 can push the data with timestamp or delta-t, send data to interface either at a predetermined time interval or as they are acquired.

The interface 56 may receive the data in association with the lapse time delta-t from the tools 10 using the tool bus 90. For example, the interface 56 may receive the data in association with the lapse time delta-t using the first encoded message. As generally shown at step 330, the interface 56 may assign a first timestamp to the data. The first timestamp may be the result of subtraction of the lapse time delta-t from the second downhole time $t_{downhole}$. In another embodiment, if the timestamp was received from the tools 10, the interface 56 may use the timestamp without adjustment. For example, the interface 56 may assign the timestamp to the data substantially at the time the interface 56 receives the data. As generally shown at step 335, the telemetry system 51 may transmit the data in association with the first timestamp from the interface 56 to the terminal 62. For example, the telemetry system 51 may transmit a second encoded message from the interface 56 to the terminal 62. The second encoded message may encode the data and the first timestamp.

As generally shown at step 340, the terminal 62 may associate one of the depths with the data received in response to the first data request. The terminal 62 may associate one of the depths with the data received in response to the first data request based on synchronization of the times with the internal timing mechanism 59 of the interface 56. The terminal 62 may associate one of the depths with the data received in response to the first data request using the first timestamp and the depth associated with a time corresponding to the first timestamp. For example, a specific pressure measurement associated with a specific time and a specific depth associated with the specific time may indicate that the specific pressure measurement may be associated with the specific depth. A data request by a terminal model is described above, but a person having ordinary skill in the art will appreciate that other models may be used, such as a data push model where the data may be sent by the interface 56 and/or tools to the terminal 62 without a specific request. The present invention should not be limited by the specific method of data transmission scheme described above. Any known techniques of data transmission could be used.

As generally shown at step 350, steps 301-340 may be repeated. For example, a second set of data may be obtained using a second data request. A second timestamp may be associated with the second set of data. Thus, a second depth may be associated with the second set of data. Any number of data requests may be transmitted and any number of sets of data may be obtained. Any number of timestamps or depths may be associated with the data. The present invention is not limited to a specific number of the data requests, the sets of data, the timestamps or the depths.

As generally shown at step 345, the terminal 62 may generate and/or may display a report, such as, for example, the depth log known to one having ordinary skill in the art. The report may have and/or may display the data in association with the timestamps and/or the depths. For example, the report may display the first set of data in association with the first depth and/or the second set of data in association with the second depth. The report may have and/or may display any number of the sets of data, the timestamps or the depths. As generally shown at step 345, steps 301-340 may be repeated. For example, additional reports may be generated and/or displayed subsequent to the report. The present invention is not limited to a specific number of reports.

Figure 4:
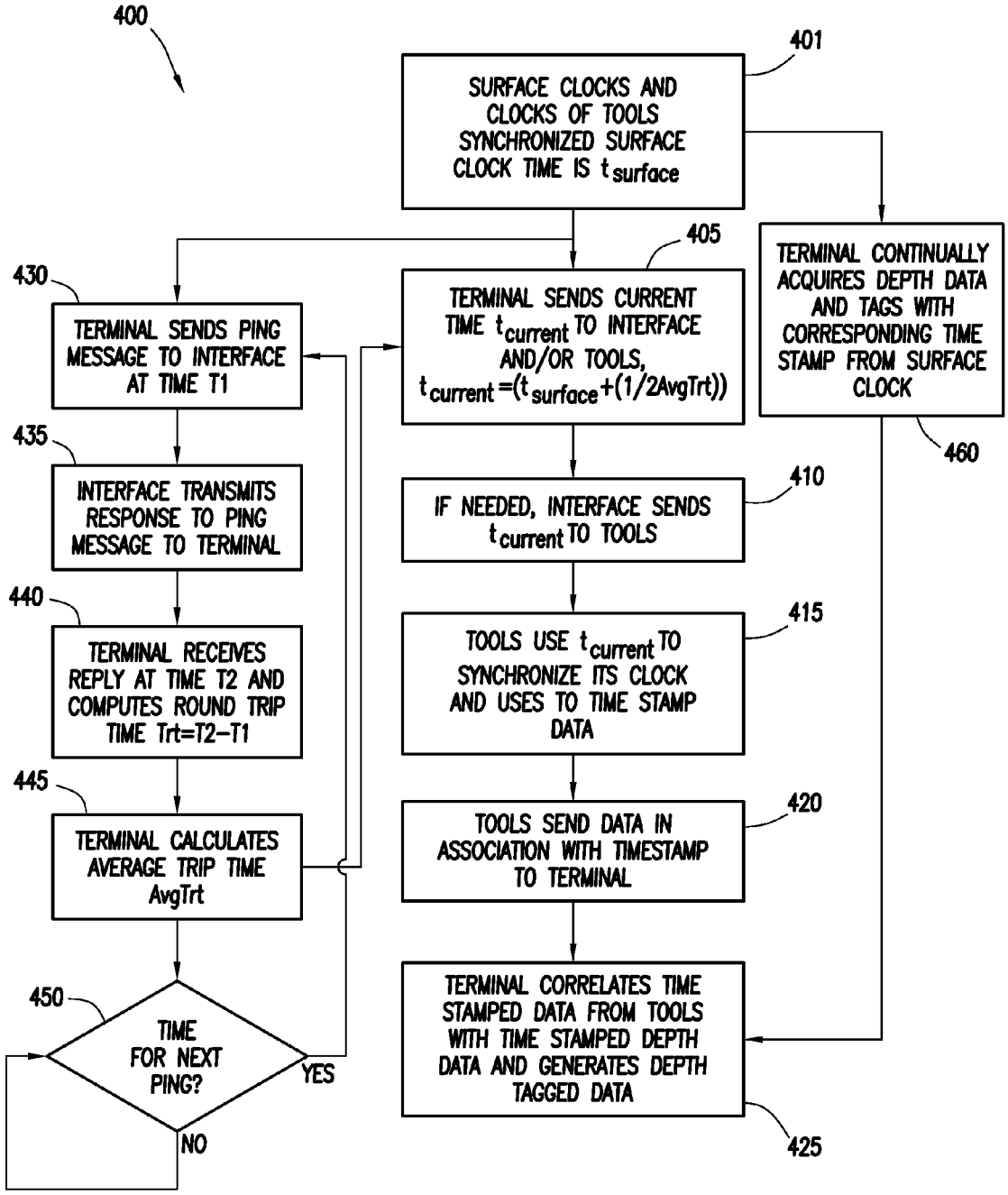
FIG. 4 illustrates a flowchart of a method for associating measurements from a wellbore with times in an embodiment of the present invention.

FIG. 4 generally illustrates a flowchart of a method 400 for using the surface clock 65 as the master clock for association of timestamps with the data in an embodiment of the present invention. The tools 10 may transmit the data to the terminal 62 in association with the timestamps as discussed in more detail hereafter.

As generally shown at step 401, the terminal 62 may determine surface times $t_{surface}$ that may be provided by the surface clock 65 of the terminal 62. As generally shown at step 430, the terminal 62 may periodically transmit a message to the interface 56 using the telemetry system 51. The message may indicate a surface time $t_{surface}$ that may be provided by the surface clock 65 of the terminal 62. For example, the message may be a "ping" message that may indicate the surface time $t_{surface}$ and/or may request a response from the interface 56. As generally shown at step 435, the interface 56 may transmit the response to the "ping" message to the terminal 62. For example, the interface 56 may transmit the response substantially simultaneous to receipt of the message.

As generally shown at step 440, the terminal 62 may determine a round-trip transmittal time Trt based on receipt of the response from the interface 56. The round-trip transmittal time may be the difference between the time the response was received by the terminal 62 relative to the time the "ping" message was sent by the terminal 62. For example, if the "ping" message was transmitted by the terminal 62 at a first time $t_1$ and the response was received by the terminal 62 at a second time $t_2$, the round-trip transmittal time may be calculated by subtracting the first time $t_1$ from the second time $t_2$.

The round-trip transmittal times associated with "ping" messages may be monitored and/or stored by the terminal 62. As generally shown at step 445, the terminal 62 may calculate an average round-trip time AvgTrt based on the round-trip transmittal times associated with previous "ping" messages. The "ping" messages transmitted from the terminal 62 to the interface 56 may indicate the average round-trip time AvgTrt of the previous "ping" messages. The terminal 62 may transmit the "ping" messages to the interface 56 periodically. For example, the terminal 62 may determine if a predetermined time interval for the next "ping" message may have lapsed as generally shown at step 450. If the predetermined time interval has lapsed, the terminal 62 may send the next "ping" message as generally shown at step 430. The present invention should not be limited by the specific method of calculating the round-trip time. For example, the time synchronization method advantageously may represent the average round-trip time and eliminate the noisy samples. Any known signal processing techniques could be used. The averaging time window can be a moving window or a finite time period with alternating window. The time period can be decided based on the time where the system changes the round-trip time significantly. This time period can be variable as system requires. It can be adjusted manually or automatically.

As generally shown at step 405, the terminal 62 may transmit the surface time $t_{surface}$ and/or the average round-trip time AvgTrt to the interface 56 and/or the tools 10 using the telemetry system 51. For example, the tools 10 may receive the surface time $t_{surface}$ and/or the average round-trip time AvgTrt from the interface 56 using the tool bus 90 as generally shown at step 410. The "ping" message sent to the interface 56 may have the surface time $t_{surface}$ and/or the average round-trip time AvgTrt. The interface 56 and/or the tools 10 may determine a current time based on the surface time $t_{surface}$ and/or the average round-trip time AvgTrt. For example, the current time $t_{current}$ may be calculated by adding half of the average round-trip time AvgTrt to the surface time $t_{surface}$ provided by the message from the terminal. For example, $t_{current}=t_{surface}+\frac{1}{2}(\text{AvgTrt})$. The interface 56 may synchronize its clock with the current time and may continually update its internal clock as shown in 415. The interface 56 may transmit the current time $t_{current}$ to the tools 10 using the tool bus 90. The tools 10 may use the time $t_{current}$ to synchronize its clock and may continually update its internal clock time. In another embodiment, the interface 56 or one of the tools 10 can be the source of the master clock for synchronization.

As generally shown at step 420, the tools 10 may obtain the data and/or may associate the updated current time with the data. The tools 10 may associate the data and/or sets of data with a timestamp based on the current time $t_{current}$. The tools 10 may transmit the data in association with the current time $t_{current}$ to the interface 56 using the tool bus 90 and/or to the terminal 62 using telemetry system 51.

One or more of the tools 10 may not be capable of determining time internally. For example, one or more of the tools 10 may not be capable of determining time internally because one or more of the tools 10 may not have an internal battery-powered clock. The tools 10 that may not have an internal battery-powered clock may be reset and/or may lose power. However, the tools 10 that may not be capable of determining time internally may associate the data with the updated current time $t_{current}$. For example, the tools 10 may receive the current time $t_{current}$ from the interface 56 at regular interval. Alternatively, the tools may determine the current time $t_{current}$ based on transmittal of the average round-trip time $t_{roundtrip}$ and/or the surface time $t_{surface}$ to the tools 10 from the interface 56.

One or more of the tools 10 may be capable of determining time internally. For example, the tools 10 that may be capable of determining time internally may have an internal battery-powered clock. The tools 10 that may be capable of determining time internally may associate the data with the updated current time $t_{current}$ transmitted from the interface 56. The tools 10 that may be capable of determining time internally may determine the current time $t_{current}$ based on the average round-trip time AvgTrt and/or the surface time $t_{surface}$ that may be transmitted from the interface 56. The tools 10 that may be capable of determining time internally may not associate the data with time determined internally, such as, for example, time provided by the internal battery-powered clock.

As discussed previously, the terminal 62 may determine depths of the drill bit 15 and/or the drill string 14 at various times as generally shown at step 460. Knowing the design of the BHA and the drill string, depths of each measurement sensors can be calculated for a given time. For example, the terminal 62 may associate the depths with times provided by the surface clock 65. The present invention is not limited to a specific embodiment of the method for associating the depths with the various times.

As generally shown at step 425, the terminal 62 may associate the depths with the data. For example, the terminal 62 may associate one of the depths corresponding to a specific time with a portion of the data corresponding to the specific time. The terminal 62 may generate and/or may display the depth log that may have and/or may display the data in association with the times and/or the depths. For example, the report may display each of the depths in association with the corresponding portion of the data.

Figure 5:
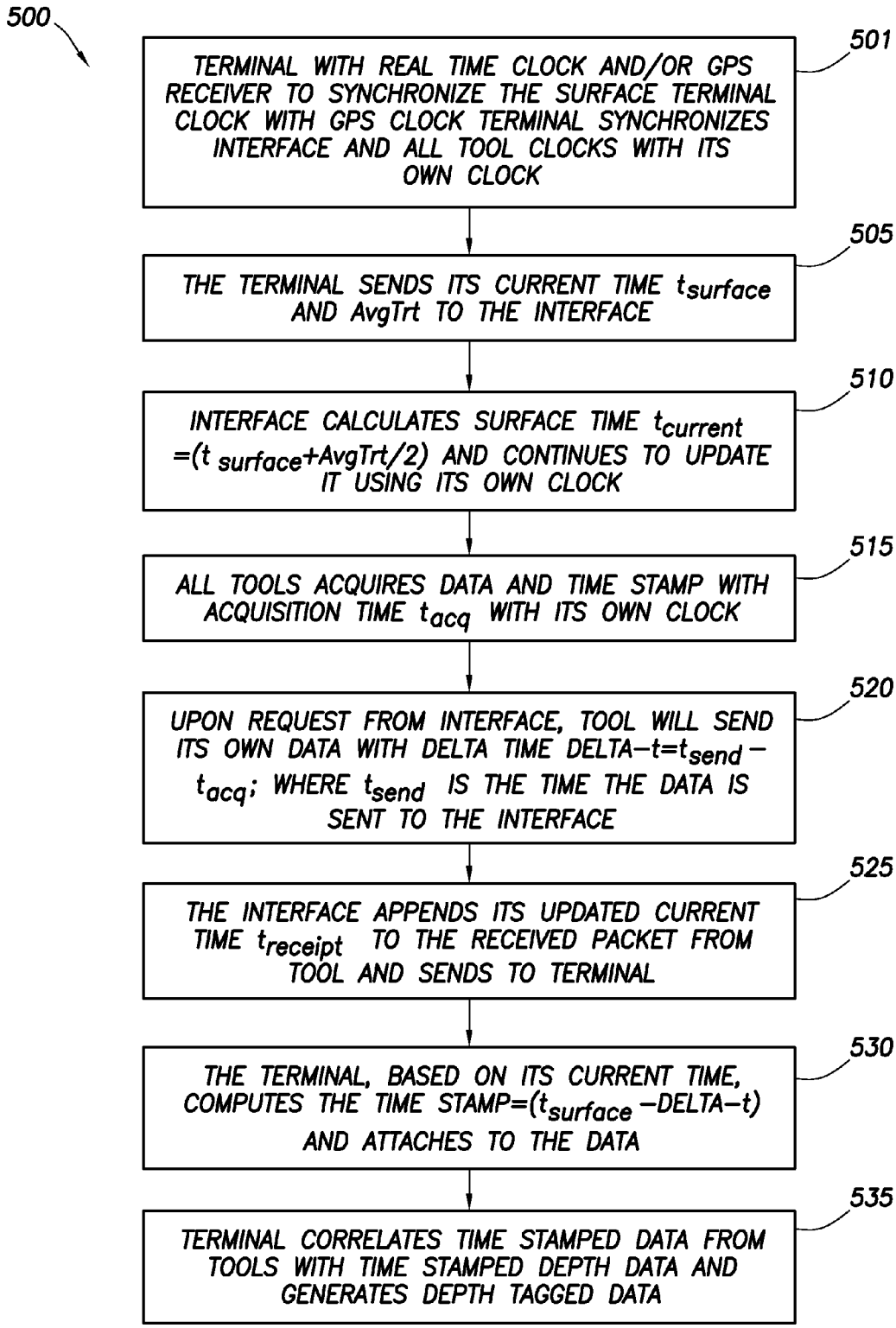
FIG. 5 illustrates a flowchart of a method for associating measurements from a wellbore with times in an embodiment of the present invention.

FIG. 5 generally illustrates a flowchart of a method 500 for using the surface clock 65 as the master clock for association of timestamps with the data in an embodiment of the present invention. The terminal 62 may associate the data obtained by the tools 10 with the timestamps as discussed in more detail hereafter.

As generally shown in FIG. 4 at step 430-450, the terminal 62 may determine an average round-trip transmittal time AvgTrt based on receipt of the response from the interface 56. As generally shown at step 505, the terminal 62 may transmit the surface time $t_{surface}$ and/or the average round-trip time AvgTrt to the interface 56 using the telemetry system 51. The "ping" message sent to the interface 56 may have the surface time $t_{surface}$ and/or the average round-trip time AvgTrt. As generally shown at step 510, the interface 56 may determine a current time based on the surface time $t_{surface}$ and/or the average round-trip time AvgTrt. For example, the current time $t_{current}$ may be calculated by adding half of the average round-trip time AvgTrt to the surface time $t_{surface}$ provided by the message from the terminal. For example, $t_{current}=t_{surface}+(\frac{1}{2}(\text{AvgTrt}))$. In another embodiment the computed $t_{current}$ may be sent by the terminal 62 to interface 56. The interface 56 or the tools 10 can use the time $t_{current}$ to synchronize their internal time and continually update their internal clocks.

As generally shown at step 515, the tools 10 may obtain the data and/or may associate an acquisition time $t_{acq}$, tools 10 internal clock time, with the data. The tools may associate the data with a timestamp based on the acquisition time $t_{acq}$. The tools 10 may determine the acquisition time $t_{acq}$ internally. For example, the tools 10 may have an internal battery-powered clock, and/or the internal battery-powered clock may provide the acquisition time $t_{acq}$. The tools 10 may store the obtained data and the associated time stamp in its internal memory.

The terminal 62 and/or the interface 56 may transmit a first data request that may request a first set of the data from the tools 10. The interface 56 may transmit the first data request to the tools 10 using the tool bus 90. The terminal 62 may direct that the interface 56 transmit the first data request, and/or the first data request may be one of a plurality of data requests transmitted from the interface 56 periodically at predetermined time intervals. The first data request may indicate which of the tools 10 may be intended to respond to the first data request. For example, the first data request may be a packet that has a header that may specify one or more of the tools 10 from which the data is requested. In another embodiment, data may be pushed by tools 10 to the interface 56 using tool bus 90 or to the terminal 62 using the telemetry 51. Communicating data over bus or network is well known to the skill in the art and should not be considered as limiting the present invention.

As generally shown at step 520, the tools 10 specified by the first data request may transmit the first set of the data in association with a lapse time delta-t to the interface 56 using the tool bus 90. The lapse time delta-t may be the difference between when the first set of the data was obtained $t_{acq}$ and a time $t_{send}$ when the tools 10 transmit the first set of the data. The tools 10 may determine the lapse time delta-t=$t_{send}-t_{acq}$. For example, the tools 10 may have an oscillator, such as, for example, a quartz crystal, as known to one having ordinary skill in the art, for determining the lapse time delta-t. For example, the lapse time delta-t may be calculated by subtracting the acquisition time $t_{acq}$ from the time $t_{send}$ when the data is transmitted by the tools 10.

For example, the tools 10 may transmit a first encoded message that may encode the first set of the data in association with the lapse time delta-t. The lapse time delta-t may be encoded by a smaller encoded message relative to a message encoding the current time, and/or communication of the lapse time delta-t may require less bandwidth relative to communication of the current time. In this method of transmitting delta-t with the data from tools 10, the tools 10 may not synchronize their own clocks with the interface 56 and/or the terminal clock or the tools 10 may not require battery backed up real time clock. The tools 10 may transmit the first encoded message to the interface 56 using the tool bus 90. The present invention is not limited to a specific embodiment of the first encoded message.

As generally shown at step 525, the interface 56 may receive the first set of the data in association with the lapse time delta-t from the tools 10 using the tool bus 90. The interface 56 may associate the first set of the data and/or the lapse time delta-t with a data receipt time $t_{receipt}$ determined by the interface 56. For example, the data receipt time $t_{receipt}$ may be the most recent current time $t_{current}$ determined by the interface 56 when the first set of the data is received. The most recent current time $t_{current}$ may be based on the surface time $t_{surface}$ and/or the average round-trip time $t_{roundtrip}$ transmitted in the most recent message from the terminal 62. The telemetry system 51 may transmit a second encoded message from the interface 56 to the terminal 62. The second encoded message may encode the first set of the data, the lapse time delta-t and/or the data receipt time $t_{receipt}$ determined by the interface 56. For example, the interface 56 may generate the second encoded message by adding a coding segment to the first encoded message. The coding segment added to the first encoded message may encode the data receipt time $t_{receipt}$ determined by the interface 56. For example, a remainder of the second encoded message may be substantially similar to the first encoded message.

As generally shown at step 530, the terminal 62 may determine the first timestamp for the first set of the data. A value of the first timestamp may be calculated by subtracting the lapse time delta-t from the data receipt time $t_{receipt}$ transmitted from the interface 56 with the first set of the data. For example, the lapse time delta-t and/or the data receipt time $t_{receipt}$ may be encoded by the second encoded message. In another embodiment, the interface 56 may compute the timestamp by subtracting the lapse time delta-t from the data receipt time $t_{receipt}$ and send it to the terminal 62, such as in the encoded message.

As discussed previously, the terminal 62 may determine depths of the drill bit 15 and/or the drill string 14 at various times as generally shown at step 460. For example, the terminal 62 may associate the depths with times provided by the surface clock 65. The present invention is not limited to a specific embodiment of the method for associating the depths with the various times.

As generally shown at step 535, the terminal 62 may associate the depths with the data. For example, the terminal 62 may associate one of the depths with the first set of the data, and/or the terminal 62 may associate a different one of the depths with a second set of the data obtained at a different time relative to the first set of the data. The terminal 62 may generate and/or may display the depth log that may have and/or may display the data in association with the times and/or the depths.

Figure 6:
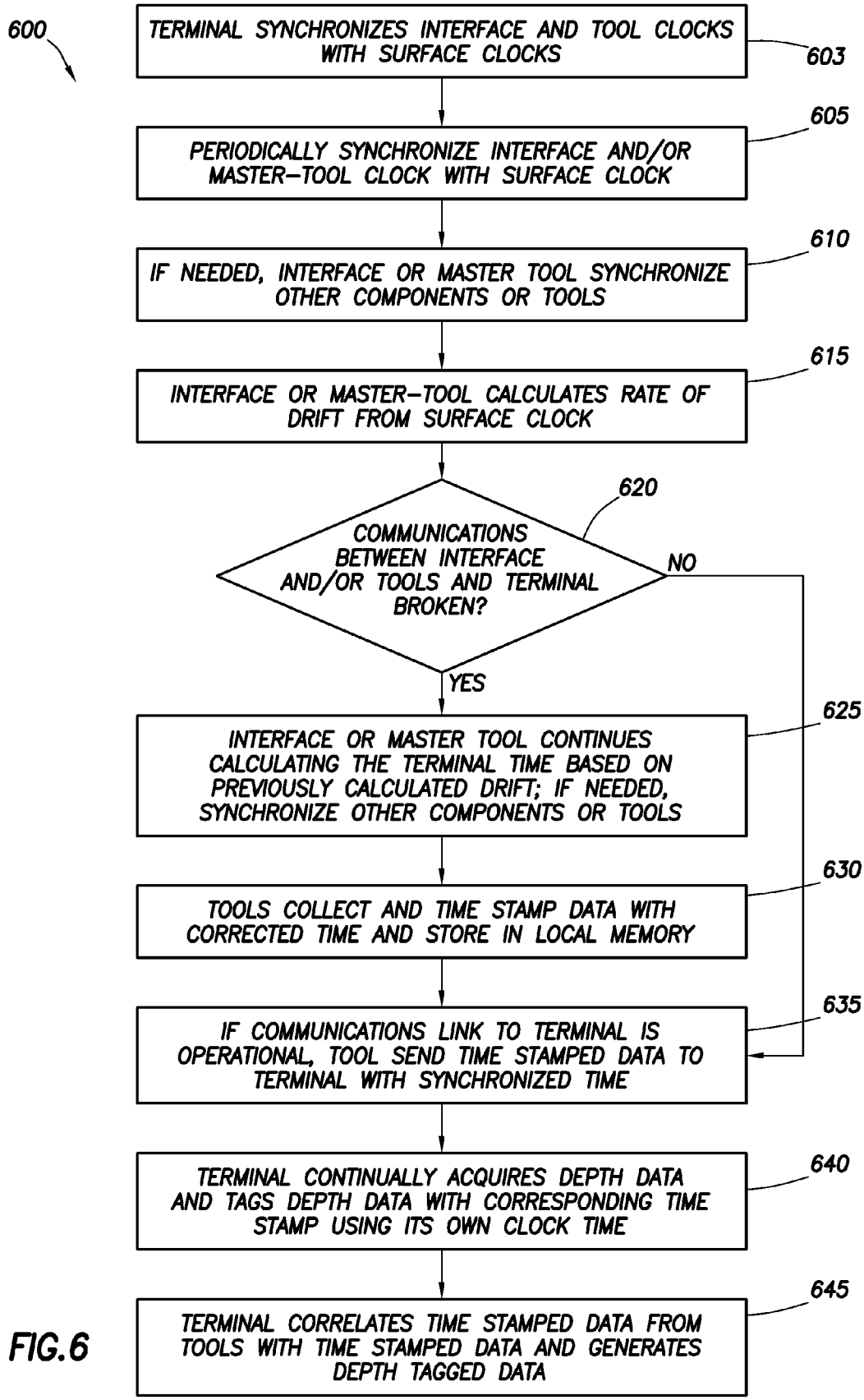
FIG. 6 illustrates a flowchart of a method for associating measurements from a wellbore with times in an embodiment of the present invention.

FIG. 6 generally illustrates a flowchart of a method 600 for associating timestamps with the data in an embodiment of the present invention. The tools 10 may associate the timestamps with the data as discussed in more detail hereafter.

As generally shown at step 603, the interface 56, the tools 10 and/or the surface clock 65 may synchronize before the telemetry system 51 and/or the tools 10 are used within the borehole 30. As generally shown at step 605, the interface 56 and/or one of the tools 10 that may be a master tool may periodically synchronize with the surface clock 65. As discussed previously, the internal timing mechanism 59 of the interface 56 may experience drift relative to the surface clock 65, and/or internal clocks of the tools 10 may experience drift relative to the surface clock 65. As a result of the drift of the internal timing mechanism 59 of the interface 56 and/or the internal clocks of the tools 10, a time provided by the internal timing mechanism 59 and/or the internal clocks of the tools 10 at a specific time may not match a time provided by the surface clock 65 at the specific time. The drift of the internal timing mechanism 59 of the interface 56 and/or the internal clocks of the tools 10 may prevent the interface and/or the tools 10, respectively, from providing accurate time information for the data. Therefore, the interface 56 and/or a master tool may periodically synchronize the internal timing mechanism 59 of the interface 56 and/or the internal clock of the master tool, respectively, with the surface clock 65.

The interface 56 and/or the master tool may use any means known to one having ordinary skill in the art to synchronize the internal timing mechanism 59 of the interface 56 and/or the internal clock of the master tool with the surface clock 65. For example, the internal timing mechanism 59 of the interface 56 and/or the clock of the master tool may be synchronized with the surface clock 65 using messages transmitted from the terminal 62.

As generally shown at step 610, the interface 56 and/or the master tool may synchronize the internal clocks of the tools 10 with the internal timing mechanism 29 of the interface 59 and/or the internal clock of the master tool. The interface 56 and/or the master tool may use any means known to one having ordinary skill in the art to synchronize the internal clocks of the tools with the internal timing mechanism 29 of the interface 59 and/or the internal clock of the master tool. For example, the internal clocks of the tools may be synchronized with the internal timing mechanism 29 of the interface 59 and/or the internal clock of the master tool using messages transmitted to the tools 10.

As generally shown at step 615, the interface 56 and/or the master tool may determine a rate of drift. The drift may be a function of time elapsed since the interface 56 and/or the tools 10 were synchronized with the surface clock 65. The rate of drift may be any value or calculation that may be used to determine the drift of the internal timing mechanism 59 of the interface 56 and/or the internal clock of the master tool as known to one having ordinary skill in the art. The rate of drift may be any value or calculation that may be used to synchronize the internal timing mechanism 59 of the interface 56 and/or the internal clock of the master tool as known to one having ordinary skill in the art. The present invention is not limited to a specific embodiment of calculating the rate of drift.

As generally shown at step 620, the interface 56 and/or the master tool may determine if communication using the telemetry system 51 may be prevented and/or may be hindered. For example, if the telemetry system 51 may be the wired drill pipe 100, adjacent joints of the WDP joints 110 the wired drill pipe may be separated. If the communication using the telemetry system 51 may be prevented and/or may be hindered, the interface 56 and/or the master tool may continuously estimate the surface clock timing using the rate of drift calculated before the communication using the telemetry system 51 was prevented and/or was hindered as generally shown at step 625. The interface 56 and/or the master tool may synchronize the internal clocks of the tools 10 with the internal timing mechanism 29 of the interface 59 and/or the internal clock of the master tool. For example, messages transmitted to the tools may synchronize the internal clocks of the tools 10 with the internal timing mechanism 29 of the interface 59 and/or the internal clock of the master tool.

As generally shown at step 630, the tools 501 may obtain the data and/or may associate the data with a timestamp. The timestamp may be based on synchronization of the internal clocks of the tools 10 with the internal timing mechanism 29 of the interface 59 and/or the internal clock of the master tool. Thus, the data may be associated with timestamps synchronized with the surface clock 65 despite interruption of the communication using the telemetry system 51. The tools 10 may store the data for transmission to the terminal 62 in association with the timestamps when communication using the telemetry system 51 is re-established.

As generally shown at step 635, the tools 10 may transmit the data to the terminal 62 in association with the timestamps. As discussed previously, the terminal 62 may determine depths of the drill bit 15 and/or the drill string 14 and/or associated sensors at various times as generally shown at step 640. For example, the terminal 62 may associate the depths with times provided by the surface clock 65. The present invention is not limited to a specific embodiment of the method for associating the depths with the various times.

As generally shown at step 645, the terminal 62 may associate the depths with the data. For example, the terminal 62 may associate one of the depths with the data. The terminal 62 may generate and/or may display the log that may have and/or may display the data in association with the times and/or the depths.

It should be understood that various changes and modifications to the presently preferred embodiments described herein will be apparent to those having ordinary skill in the art. Such changes and modifications may be made without departing from the spirit and scope of the present invention and without diminishing its attendant advantages. It is, therefore, intended that such changes and modifications be covered by the claims.

The following is claimed:

1. A method of associating time stamped measurement data with a corresponding wellbore depth comprising:

positioning an interface in a wellbore, wherein the interface having a master clock is in communication with a plurality of tools, each said tool has a clock and can independently measure, record and transmit data acquired from and/or through the wellbore;

continuously transmitting depth data to a terminal comprising a surface clock wherein the surface clock and master clock are synchronized and the terminal sends a current time to the interface or the tools, the clock of each said tool is synchronized to the current time;

time stamping the depth data;

obtaining measurement data from at least one tool of the plurality of tools;

time stamping the measurement data with the current time wherein time stamped measurement data is generated; and transmitting time stamped measurement data to the terminal wherein the terminal correlates the time stamped measurement data with time stamped depth data to generate depth tagged data and the terminal generates a depth log.

2. The method of claim 1 further comprising the step of periodically transmitting a ping message.

3. The method of claim 2 further comprising: determining a transmission time between the surface clock and the interface by determining a difference between a time of transmission and time of receipt of the ping message.

4. The method of claim 2 wherein the interface periodically transmits the ping message and receives a return ping message from the surface clock to determine the transmission time.

5. The method of claim 2 wherein a terminal periodically transmits the ping message and receives a return ping message from the interface to determine the transmission time.

6. The method of claim 1 further comprising the step of: synchronizing the surface clock with a global positioning system clock.

7. A method of associating time stamped measurement data with a correspondence wellbore depth comprising:

positioning an interface in a wellbore, the interface having a master clock and in communication with a plurality of tools wherein the master clock is synchronized with a surface terminal clock, the surface terminal clock is synchronized with a real time or GPS clock, and each tool of the plurality of tools has a clock that is synchronized with the master clock and can independently measure, record and transmit data acquired from and/or through the wellbore;

periodically transmitting surface time from the surface clock to the master clock wherein the interface calculates current time and updates the master clock;

obtaining measurement data related to a formation about the wellbore from at least one of the plurality of tools;

time stamping the measurement data with an acquisition time; and determining a delta time wherein the delta time is the difference between a send time of the tool and the acquisition time;

transmitting the measurement data and the delta time to the interface wherein the interface appends a receipt time to the measurement data and delta time and transmits the measurement data, the delta time and the receipt time to the terminal, the terminal computing a time stamp and attaching the time stamp to the data to generate depth tagged data.

8. A method of associating time stamped measurement data with a corresponding wellbore depth comprising:

positioning a downhole tool in a wellbore having a timing mechanism with a downhole time, wherein the downhole tool is an interface sub in communication with a plurality of tools, each said tool has a clock and can independently measure, record and transmit data acquired from and/or through the wellbore;

communicating between the downhole tool and a terminal having a surface clock positioned at Earth's surface with a telemetry system;

periodically transmitting time information between the surface clock and the downhole tool to synchronize the timing mechanism and the surface clock;

determining a drift of the downhole time in the downhole tool;

applying the drift to the downhole time wherein the downhole tool calculates a terminal time based on the drift and the plurality of tools are each synchronized with the terminal time;

obtaining measurement data from a first tool of the plurality of tools;

time stamping the measurement data to generate time stamped measurement data; and determining a delta time representing a difference in time between time the measurement data is acquired by the first tool and time the data is transmitted from the first tool, wherein the terminal generates depth tagged data based on the time stamped measurement data transmitted by tools.

9. The method of claim 8 wherein the step of applying the drift to the downhole time is performed at the downhole tool and is continued with or without the periodic transmissions of time information from the surface clock.

10. A system of associating time stamped measurement data with a corresponding wellbore depth comprising:

a drill string extending into a wellbore;

a downhole tool positioned on the drill string and having a downhole clock;

a telemetry system providing data communication along the drill string;

a surface terminal in communication with the downhole tool via the telemetry system, the surface terminal having a surface clock, wherein time information is transmitted between the surface clock and the downhole clock to synchronize the surface clock and the downhole clock;

wherein the downhole tool is an interface sub in communication with a plurality of tools, each said tool having a clock that is synchronized with the downhole clock, each said tool can independently measure, record and transmit data acquired from and/or through the wellbore;

wherein the interface sub requests data from a first tool of the plurality of tools, the first tool obtaining measurement data related to the wellbore or the formation surrounding the well bore, and further wherein the first tool determines a delta time representing a difference in time between time the measurement data was acquired in the first tool and time the measurement data is transmitted from the first tool.

11. The system of claim 10 wherein the downhole tool obtains measurement data related to a formation about the wellbore or the wellbore, and further wherein the downhole tool time stamps the measurement data based on time of the downhole clock synchronized with time of the surface clock.

12. The system of claim 10 wherein the downhole tool obtains measurement data related to the wellbore or a formation about the wellbore, and further wherein the downhole tool time stamps the measurement data with a delta time, the delta time an elapsed time since receipt of the time formation.

13. The system of claim 10 wherein each of the plurality of tools has a clock that is synchronized with the interface sub.

14. The system of claim 10 wherein the plurality of tools obtain measurement data related to the wellbore or a formation about the wellbore, and further wherein the interface sub requests the measurement data from one of the plurality of tools.

15. The system of claim 10 wherein the first tool timestamps the measurement data with the delta time and transmits the time stamped measurement data to the interface sub.

* * * * *